US008157102B2

(12) United States Patent
Christl et al.

(10) Patent No.: US 8,157,102 B2
(45) Date of Patent: Apr. 17, 2012

(54) METHOD AND APPARATUS FOR PROCESSING SHEET MATERIAL

(75) Inventors: Rudolf Christl, München (DE); Gerhard Sporer, Pöcking (DE); Klaus Buchmann, München (DE)

(73) Assignee: Giesecke & Devrient GmbH, Munich (DE)

( * ) Notice: Subject to any disclaimer, the term of this patent is extended or adjusted under 35 U.S.C. 154(b) by 2503 days.

(21) Appl. No.: 10/193,320

(22) Filed: Jul. 12, 2002

(65) Prior Publication Data

US 2003/0023342 A1 Jan. 30, 2003

(30) Foreign Application Priority Data

Jul. 12, 2001 (DE) ..... 101 33 860

(51) Int. Cl.
*B07C 5/00* (2006.01)

(52) U.S. Cl. ..... 209/534; 194/206; 194/207

(58) Field of Classification Search ..... 209/534; 194/200, 206, 207

See application file for complete search history.

(56) References Cited

U.S. PATENT DOCUMENTS

| | | | | |
|---|---|---|---|---|
| 4,025,420 | A * | 5/1977 | Horino | 209/534 |
| 4,236,639 | A * | 12/1980 | Boettge et al. | 209/534 |
| 5,917,930 | A * | 6/1999 | Kayani et al. | 382/135 |
| 6,439,395 | B1 * | 8/2002 | Voellmer et al. | 209/534 |
| 6,772,886 | B2 | 8/2004 | Werner et al. | |
| 6,994,200 | B2 * | 2/2006 | Jenrick et al. | 194/206 |
| 7,152,744 | B2 * | 12/2006 | Kunz et al. | 209/534 |

FOREIGN PATENT DOCUMENTS

| | | | |
|---|---|---|---|
| DE | 3201956 | A1 | 1/1982 |
| DE | 198 10 928 | A1 | 9/1999 |
| DE | 19958017 | A1 | 12/1999 |
| DE | 100 30 221 | A1 | 1/2002 |
| DE | 100 30 227 | A1 | 2/2002 |
| DE | 100 49 433 | A1 | 4/2002 |
| DE | 100 50 486 | A1 | 4/2002 |
| GB | 2093809 | A | 9/1982 |

* cited by examiner

*Primary Examiner* — Terrell Matthews
(74) *Attorney, Agent, or Firm* — Bacon & Thomas, PLLC

(57) ABSTRACT

The present invention relates to a method and apparatus for processing sheet material, in particular papers of value such as bank notes, checks, etc. The present invention starts out from the consideration that the validity of a successful check of sheet material is still present unchanged after an operating disturbance. The result of a check of sheet material which was performed successfully before a disturbance is therefore retained when a disturbance is present or after the disturbance has been eliminated.

15 Claims, 1 Drawing Sheet

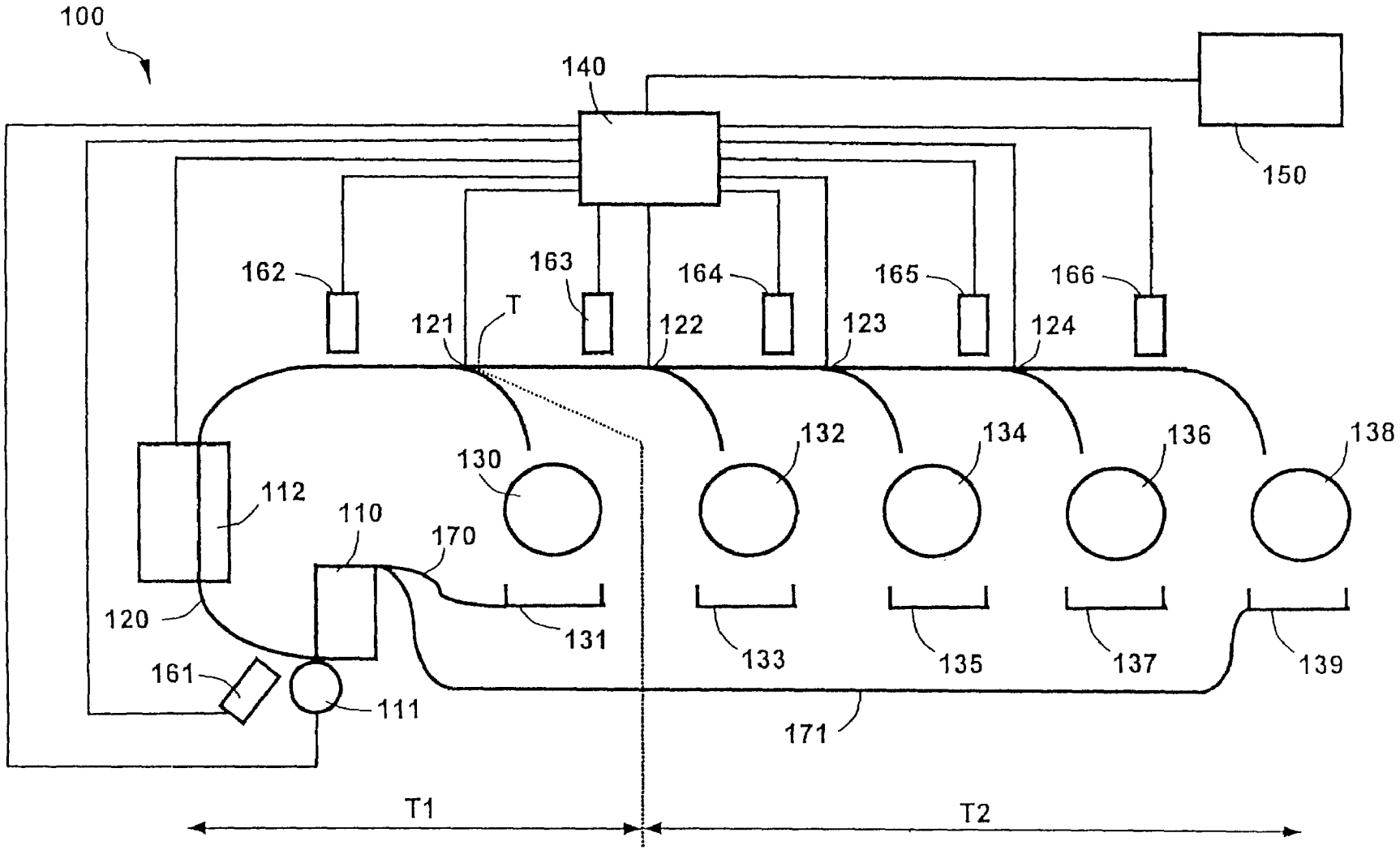
100
150
140
138
139
136
137
134
135
132
133
130
131
166
124
165
123
164
122
163
T
121
162
170
110
111
112
120
161
171
T1
T2

METHOD AND APPARATUS FOR PROCESSING SHEET MATERIAL

BACKGROUND

The present invention relates to a method and apparatus for processing sheet material, in particular papers of value such as bank notes, checks, etc.

In the processing of bank notes, a stack of bank notes is inserted into an input pocket out of which the bank notes are singled. The singled bank notes are transferred to a transport system, checked by sensors and associated with output pockets in dependence on the check. The bank notes are thereby tested for authenticity, soiling, damage, etc., and sorted into the different output pockets accordingly. Bank notes that have not been recognized clearly or faultlessly are sorted into a special output pocket, a reject pocket.

In the processing of different groups of bank notes corresponding to different deposits which may come from different depositors, the different deposits are separated by separation cards. The separation cards are inserted between the different deposits to separate them. The separation cards can be disposed at the beginning, end or the beginning and the end of the group of bank notes forming the particular deposit. The separation cards can contain information for example about the depositor and/or the deposit. Further, the separation cards are so designed as to be automatically recognized by the sensors of the bank note processing machine during processing. When a separation card is recognized, the bank note processing machine can process the associated group of bank notes, account for the corresponding deposit and enter it in the books.

However, the processing of sheet material often involves faulty processing operations caused by disturbances such as jams or other operating disturbances. This can also result in mixture of sheet material coming from different groups of sheet material, or in a change in the order of sheet material to be processed. To eliminate the disturbances, such as jams, extensive interventions by operating persons are required because, for example, the sheet material already processed and accounted for before the disturbance must be taken into consideration by the operating person so that said accounting is not changed. Moreover, the operating person must manually sort the sheet sheet material accumulating due to disturbances. Such manual processing and consideration in accounting is elaborate and very error-prone.

SUMMARY

The problem of the present invention is therefore to state a method and apparatus for processing sheet material, in particular papers of value such bank notes, checks, etc., which allow processing of the sheet material while permitting simple, uncomplicated, time-economical and error-resistant elimination of faulty processing operations.

This problem is solved according to the invention by the features discussed below.

This problem is solved according to the invention by the features of claims 1 and 7.

The invention starts out from the consideration that the validity of a successful check of sheet material is still present unchanged after an operating disturbance. The result of a check of sheet material performed successfully before a disturbance is therefore retained, even if a disturbance is present or assumed or after elimination of the disturbance, for all pieces of sheet material located at a position in processing after the rejection of the invalidly checked sheet material.

The advantage of the invention is to be seen in particular in that it speeds up the processing of sheet material in simple, uncomplicated fashion, so that time-economical and fault-resistant processing of sheet material is possible even when the processing operations are actually faulty e.g. because of being influenced by operating disturbances.

In a development it is provided that a transport system used is divided into two portions that can be driven separately.

The advantage of the development of the invention is to be seen in particular in that it permits a selective reaction to operating disturbances, which normally occur only in certain, narrowly limited areas of the transport system.

In other developments it is provided that transport devices are used that automatically supply the sheet material checked as valid and invalid and deposited in output units after a disturbance to new processing.

The advantage of said developments is to be seen in that the elimination of disturbances can be performed virtually automatically, so that in particular error-prone manual sorting and evaluation operations can be omitted.

Further advantages of the present invention result from the dependent claims and the following description of an example with reference to a figure.

BRIEF DESCRIPTION OF THE DRAWING

The single figure shows a basic structure of a bank note processing machine for processing sheet material.

DETAILED DESCRIPTION

In the following, the processing of sheet material will be described by way of example with reference to the processing of bank notes. The bank notes can also form correlated groups of sheet material, which are called deposits. The different deposits are separated from each other by separation means, for example separation cards. A bank note processing machine is used for processing the bank notes or different deposits.

The figure shows a basic structure of bank note processing machine 100 for processing bank notes or deposits. Bank note processing machine 100 has input unit 110 in which the bank notes or deposits are inserted. Input unit 110 has connected thereto singler 111 which removes single bank notes and, if present, the separation cards of the deposits from input unit 110 and transfers them singly to transport system 120. Transport system 120 transports the single bank notes and separation cards as a bank note stream through sensor device 112 which determines data of the bank notes by means of sensors, permitting for example conclusions as to authenticity, state, denomination, etc. Furthermore, the separation cards are recognized in sensor device 112 and any information contained on the separation card detected by sensor device 112. The determined data of the bank notes and the detected information of the separation cards are transferred to control device 140 which evaluates the data and information and uses them to control the further flow of bank notes and separation cards through bank note processing machine 100. Control device 140 thus acts on diverters 121 to 124 which are parts of transport system 120 and allow the bank notes and separation cards to be deposited in output units 130 to 139 according to predetermined criteria. Output units 130 to 139 can be formed for example as spiral slot stackers which stack slot stackers which stack the bank notes and separation cards to be deposited in bins 131, 133, 135, 137, 139 by means of rotating units 130, 132, 134, 136, 138 having spiral slots. The operation of bank note processing machine 100 is controlled by means of input/output device 150 having e.g. a display and a keyboard for this purpose.

The separation cards can be used, as mentioned above, for recognizing the limits of different deposits during automatic bank note processing and for mutually delimiting rejected bank notes, i.e. bank notes which were classified as false or faulty or could not be classified during the check by sensor device 112 and control device 140. The separation cards are then additionally outputted and deposited together with the false or faulty or unclassifiable bank notes in output unit 130, 131, used as a reject unit.

Problems in the processing of bank notes or deposits in bank note processing machine 100 occur when there are operating disturbances such as jams, etc. For recognizing disturbances, bank note processing machine 100 can have for example detectors 161 to 166, e.g. light barriers. Light barriers 161 to 166 are disposed along transport system 120 and permit monitoring of proper processing of the stream of bank notes and separation cards in bank note processing machine 100 from input unit 110 up to output units 130 to 139. For this purpose, the signals of light barriers 161 to 166 are evaluated by control device 140. If a disturbance, e.g. jam, is recognized or suspected, control device 140 stops further processing of the bank notes and separation cards by bank note processing machine 100. In particular singler 111 and transport system 120 are thereby stopped.

The bank notes (bank note stream) and separation cards being processed at this time, i.e. the bank notes and separation cards located in transport system 120, are thereby divided into two portions T1, T2 along transport system 120. In first portion T1 along transport system 120, from singler 111 up to diverter 121 of reject unit 130, 131, no secure statement about the bank notes of the bank note stream or separation cards is possible. In second portion T2 along transport system 120, after diverter 121 of reject unit 130, 131 up to last output unit 138, 139, a secure statement about the bank notes of the bank note stream is possible since these are bank notes recognized by sensor device 112 and accounted for by control device 140. All unaccepted bank notes, i.e. bank notes whose check by sensor device 112 and control device 140 gave rise to objections of some kind, i.e. which are faulty, false, suspected forgeries or unrecognizable, have already been outputted together with any separation cards used into reject unit 130, 131, as described above, or are still located in first portion T1 of transport system 120.

When the cause of the disturbance has been recognized and eliminated, the bank notes and separation cards in first portion T1 of transport system 120 are removed and supplied to new processing, i.e. inserted into input unit 110. Simultaneously, the bank notes and separation cards can be removed from reject unit 130, 131 and reprocessed with the bank notes and separation cards of first portion T1 of transport system 120. It is thus possible to completely process and account for the bank notes or deposits inserted into input unit 110 originally, i.e. before the occurrence of the disturbance.

The bank notes in second portion T2 of transport system 120 are likewise removed but need not be checked by sensor device 112 since they have been properly processed, as described above, i.e. the bank notes have been recognized, accepted and accounted for. This means that they have in particular been taken into consideration properly when the processed bank notes or deposits were accounted for so that they must not be accounted for again. The removed bank notes can be inserted into input unit 110 and sorted again at the end of processing of all bank notes or deposits. This means that the bank notes are only examined according to the selected sorting criteria, e.g. denomination, and distributed over output units 132 to 139, where the bank notes previously processed properly may be located.

For removal of the bank notes and separation cards it can also be provided that after processing has been stopped, as described above, only transport system 120 is set going by control device 140. Before that, control device 140 additionally actuates diverter 121 of reject unit 130, 131. All bank notes and separation cards in first portion T1 of transport system 120 are thus transported into reject unit 130, 131, but all bank notes in second portion T2 of transport system 120 into output unit 138, 139 disposed last, regarded in the transport direction, which is operated as disturbance unit 138, 139. The bank notes and separation cards in reject unit 130, 131 and disturbance unit 138, 139 can then be processed further as described above. In particular, it can be provided that reject unit 130, 131 and/or disturbance unit 138, 139 are connected with transport devices 170 and/or 171 with input unit 110, so that the bank notes and separation cards in reject unit 130, 131 and/or disturbance unit 138, 139 can be transported into input unit 110 to be reprocessed, as described above.

Alternatively, it can be provided that transport system 120 is divided up and decoupled mechanically at place T. The two portions T1 and T2 of transport system 120 can then also be operated individually. This permits e.g. the bank notes located in second portion T2 to be first transported into output units 132 to 139, in particular disturbance unit 138, 139, and deposited there. Then the bank notes and separation cards of first portion T1 of transport system 120 can be transported into one of output units 130 to 139, in particular reject unit 130, 131, and deposited there. Further processing is effected as described above.

A further alternative results if only singler 111 is stopped when a disturbance is recognized or assumed. Transport system 120 can in this case be operated further. The bank notes and separation cards in first and second portions T1 and T2 of transport system 120 are then transported into output units 130, 131 and 138, 139 and deposited there, as described above. Only one of portions T1 or T2 can also be operated further, as described above. This is of advantage in particular when a Jam is recognized or suspected in one of portions T1 and T2 of transport system 120. Said portion T1 or T2 is then stopped together with singler 111 by control device 140. The bank notes and separation cards in other portion T2 or T1 of transport system 120 are transported into output units 130, 131 or 138, 139 and deposited there, as described above. Then the cause of the disturbance in relevant portion T1 or T2 can be eliminated and processing continued, as described above.

The invention claimed is:

1. A method for processing sheet material, comprising the following steps:

singling the sheet material and forming a sheet stream, transporting the sheet stream comprising singled sheet material along a sheet transport path through a checking device to a plurality of output units, the sheet transport path having a first portion and a second portion downstream from the first portion, checking the sheet stream with the checking device, classifying the singled sheet material of the sheet stream as valid sheet material and/or invalid sheet material on the basis of the check, and transporting the sheet material of the sheet stream from the sheet transport path into the output units in dependence on the check, wherein the result of the check of the valid sheet material is retained, if an operating disturbance is present and/or assumed, and the valid sheet material is sorted without a new validity check and transported from the sheet transport path into the output units after elimination of the disturbance, and wherein after the elimination of disturbance the valid sheet material is removed from the second portion of the sheet transport path and inserted into an input unit for further processing without a new validity check.

2. The method according to claim 1, wherein the invalid sheet material is processed and checked again after elimination of the disturbance.

3. The method according to claim 1, wherein the sheet material to be processed is processed in groups of bank notes, and the groups of bank notes are separated from each other by a separation element.

4. The method according to claim 3, wherein the separation elements are deposited during processing with the invalid sheet material in one of the output units.

5. An apparatus for processing, sheet material, comprising:

an input unit for inputting sheet material, a singler for singling the inputted sheet material and forming a sheet stream, a sensor device arranged to check the sheet stream, a transport system arranged to transport the sheet stream comprising singled sheet material along a sheet transport path through the sensor device, the sheet transport path having a first portion and a second portion downstream from the first portion, a control device arranged to classify the singled sheet material of the sheet stream as valid and/or invalid sheet material on the basis of the check by the sensor device, output units disposed along the sheet transport path to receive the sheet material transported by the transport system, under the control of the control device, in dependence on the check, the output units including a reject unit arranged to receive invalid sheet material, wherein the reject unit is disposed along the first portion of the sheet transport path, and detectors arranged to monitor the apparatus for the presence of operating disturbances, wherein the control device is arranged to drive the detectors and includes a function to stop the singler when a disturbance is ascertained and/or assumed, and the control unit is arranged to drive the transport system so that the sheet material located in the second portion of the sheet transport path is transported into the output units disposed along the second portion of the sheet transport path; and wherein the result of the check of the valid sheet material is retained, if an operating disturbance is present and/or assumed, and the valid sheet material is sorted without a new validity check and transported from the sheet transport path into the output units disposed along the second portion of the sheet transport path after elimination of the disturbance, and wherein after the elimination of disturbance the valid sheet material is removed from the second portion of the sheet transport path and inserted into an input unit for further processing without a new validity check.

6. The apparatus according to claim 5, wherein the transport system is arranged to transport the sheet material located in the portion of the transport system before the reject unit the reject unit.

7. The apparatus according to claim 5 wherein the control device is arranged to monitor the detectors and includes a function to stop the transport system or a part of the transport system when a disturbance is ascertained or assumed.

8. The apparatus according to claim 7, wherein the control device includes a function to start the transport system or at least a part of the transport system when the control device ascertains that the disturbance is eliminated during monitoring of the detectors.

9. The apparatus according to claim 5, wherein the control unit is arranged to drive the transport system so that the sheet material located in the portion of the transport system following the reject unit is transported into the output unit disposed at the end of the transport system.

10. The apparatus according to claim 9, wherein a transport device is arranged to transport the sheet material deposited in the last output unit into the input unit.

11. The apparatus according to claim 10, wherein the sheet material transported by the transport device from the last output unit into the input unit is arranged to be transported into the output units without classification for validity.

12. The apparatus according to claim 5, wherein a transport device is arranged to transport the sheet material deposited in the reject unit into the input unit.

13. The apparatus according to claim 12, wherein the sheet material transported by the transport device from the reject unit into the input unit is arranged to be classified for validity again and transported into the output units.

14. The apparatus according to claim 5, including a separating element input arrangement arranged to input separation elements into the input unit together with the sheet material, and the separation elements are arranged to separate different groups of sheet material from each other.

15. The apparatus according to claim 14, wherein the transport system transports the separation elements into the reject unit.

* * * * *